US009719059B2

(12) United States Patent
Massey-Brooker et al.

(10) Patent No.: US 9,719,059 B2
(45) Date of Patent: Aug. 1, 2017

(54) LAMELLAR PHASE-CONTAINING LAUNDRY DETERGENT IN A MULTI-COMPARTMENT WATER-SOLUBLE POUCH

(71) Applicant: The Procter & Gamble Company, Cincinnati, OH (US)

(72) Inventors: Anju Deepali Massey-Brooker, Newcastle upon Tyne (GB); Mauro Vaccaro, Newcastle upon Tyne (GB); Eric San Jose Robles, Newcastle upon Tyne (GB); Nigel Patrick Somerville Roberts, Newcastle upon Tyne (GB); Melissa Cuthbertson, Tyne & Wear (GB); Marios Hatzopoulos, Reading (GB); Yvonne Bridget McMeekin, Northumberland (GB); Jonathan Richard Clare, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 97 days.

(21) Appl. No.: 14/964,638

(22) Filed: Dec. 10, 2015

(65) Prior Publication Data

US 2016/0168517 A1 Jun. 16, 2016

(30) Foreign Application Priority Data

Dec. 12, 2014 (EP) ..... 14197597

(51) Int. Cl.

| | |
|---|---|
| ***C11D 1/22*** | (2006.01) |
| ***C11D 1/82*** | (2006.01) |
| ***C11D 3/43*** | (2006.01) |
| ***C11D 9/36*** | (2006.01) |
| ***C11D 9/44*** | (2006.01) |
| ***C11D 17/04*** | (2006.01) |
| ***C11D 1/29*** | (2006.01) |
| ***C11D 3/00*** | (2006.01) |
| ***C11D 3/18*** | (2006.01) |
| ***C11D 3/20*** | (2006.01) |
| ***C11D 3/37*** | (2006.01) |
| ***C11D 11/00*** | (2006.01) |
| ***C11D 3/50*** | (2006.01) |
| ***C11D 17/00*** | (2006.01) |

(52) U.S. Cl.

CPC ..... *C11D 17/045* (2013.01); *C11D 1/22* (2013.01); *C11D 1/29* (2013.01); *C11D 3/0015* (2013.01); *C11D 3/18* (2013.01); *C11D 3/202* (2013.01); *C11D 3/2013* (2013.01); *C11D 3/2031* (2013.01); *C11D 3/2079* (2013.01); *C11D 3/373* (2013.01); *C11D 3/50* (2013.01); *C11D 11/0094* (2013.01); *C11D 17/0026* (2013.01)

(58) Field of Classification Search

CPC .. C11D 1/22; C11D 1/82; C11D 3/001; C11D 3/162; C11D 3/373; C11D 3/505; C11D 3/43; C11D 7/3218; C11D 9/36; C11D 9/44; C11D 11/0017; C11D 17/0041; C11D 17/042

See application file for complete search history.

(56) References Cited

U.S. PATENT DOCUMENTS

| | | | | |
|---|---|---|---|---|
| 6,077,816 | A * | 6/2000 | Puvvada | C11D 17/00 510/130 |
| 2003/0223952 | A1 | 12/2003 | Wells et al. | |
| 2006/0024256 | A1 | 2/2006 | Wells et al. | |
| 2011/0188784 | A1 | 8/2011 | Denome et al. | |
| 2012/0093757 | A1 | 4/2012 | Murray et al. | |
| 2012/0220510 | A1* | 8/2012 | Clapp | A61K 8/0295 510/159 |
| 2012/0308502 | A1* | 12/2012 | Wise | A61K 8/342 424/70.1 |

FOREIGN PATENT DOCUMENTS

| | | | |
|---|---|---|---|
| WO | WO 96/02229 | A2 | 2/1996 |
| WO | WO 03/015736 | A2 | 2/2003 |
| WO | WO 2004/024114 | A2 | 3/2004 |
| WO | WO 2006/012767 | A1 | 2/2006 |
| WO | WO 2008/110590 | A1 | 9/2008 |
| WO | WO 2009/072027 | A2 | 6/2009 |

OTHER PUBLICATIONS

Extended European Search Report; Application No. 14197591.2-1357; dated Jun. 3, 2015; 7 pages.
Extended European Search Report; Application No. 14197597.9-1357; dated Jun. 3, 2015; 9 pages.
Extended European Search Report; Application No. 14197594.6-1357; dated Jun. 3, 2015; 7 pages.
U.S. Appl. No. 14/964,625, filed Dec. 10, 2015, Anju Deepali Massey-Brooker et al.
U.S. Appl. No. 14/924,628, filed Dec. 10, 2015, Anju Deepali Massey-Brooker et al.

* cited by examiner

*Primary Examiner* — Charles Boyer
(74) *Attorney, Agent, or Firm* — Jason J Camp

(57) ABSTRACT

The present invention provides a multi-compartment laundry detergent water-soluble pouch, wherein the pouch comprises a first compartment and a second compartment, wherein the first compartment comprises a benefit delivery composition, wherein the second compartment comprises a detergent ingredient, wherein the benefit delivery composition comprises a lamellar phase composition and a viscous hydrophobic ingredient, wherein the lamellar phase composition comprises a mixture of surfactant and fatty amphiphile in lamellar phase, wherein the viscous hydrophobic ingredient comprises silicone and/or petrolatum.

14 Claims, No Drawings

LAMELLAR PHASE-CONTAINING LAUNDRY DETERGENT IN A MULTI-COMPARTMENT WATER-SOLUBLE POUCH

FIELD OF THE INVENTION

The present invention relates to multi-compartment laundry detergent water-soluble pouches.

BACKGROUND OF THE INVENTION

Viscous hydrophobic materials such as silicones and petrolatum are incorporated into laundry detergent products. It is desirable for these materials to be delivered onto the fabric surface during the laundering process. However, these materials are typically incorporated into these laundry detergent products at very low levels, and the efficiency of their deposition onto the fabric surface during the laundering process is also low. There remains a need to improve the performance of these materials during the laundering process, such as fabric softening performance.

The Inventors have found that the performance of these viscous hydrophobic materials is significantly improved when they are incorporated into a benefit delivery composition that additionally comprises a mixture of surfactant and fatty amphiphile in lamellar phase, and when the benefit delivery composition is incorporated into a multi-compartment laundry detergent water-soluble pouch. Such pouches provide a benefit delivery composition that exhibits excellent performance, such as fabric softening performance.

In addition, when the viscous hydrophobic material, such as silicone, is mixed with perfume and incorporated into the above described pouch, such pouches exhibit improved perfume performance.

SUMMARY OF THE INVENTION

The present invention relates to a multi-compartment laundry detergent water-soluble pouch, wherein the pouch comprises a first compartment and a second compartment, wherein the first compartment comprises a benefit delivery composition, wherein the second compartment comprises a detergent ingredient, wherein the benefit delivery composition comprises a lamellar phase composition and a viscous hydrophobic ingredient, wherein the lamellar phase composition comprises a mixture of surfactant and fatty amphiphile in lamellar phase, wherein the viscous hydrophobic ingredient comprises silicone and/or petrolatum.

DETAILED DESCRIPTION OF THE INVENTION

Multi-compartment laundry detergent water-soluble pouch: The multi-compartment laundry detergent water-soluble pouch comprises a first compartment and a second compartment. These first and second compartments are described in more detail below.

The detergent pouch typically has a height, a width and a length. The maximum of any of these dimensions is meant to mean the greatest distance between two points on opposite sides of the detergent pouch. In other words, the detergent pouch may not have straight sides and so may have variable lengths, widths and heights depending on where the measurement is taken. Therefore, the maximum should be measured at any two points that are the furthest apart from each other. The maximum length is typically between 2 cm and 5 cm, or even between 2 cm and 4 cm, or even between 2 cm and 3 cm. The maximum length maybe greater than 2 cm and less than 6 cm. The maximum width is typically between 2 cm and 5 cm. The maximum width maybe greater than 3 cm and less than 6 cm. The maximum height is typically between 2 cm and 5 cm. The maximum height maybe greater than 2 cm and less than 4 cm. Preferably, the length: height ratio is from 3:1 to 1:1; or the width: height ratio is from 3:1 to 1:1, or even 2.5:1 to 1:1; or the ratio of length to height is from 3:1 to 1:1 and the ratio of width to height is from 3:1 to 1:1, or even 2.5:1 to 1:1, or a combination thereof. Without wishing to be bound by theory, the Inventors found that by carefully regulating the length, width and height of the detergent pouch, they were less likely to become trapped between the door and the seal, or within the seal itself of an automatic laundry washing machine.

Typically, the detergent pouch comprises a liquid laundry detergent composition. The volume of the liquid laundry detergent composition within the detergent pouch maybe between 10 and 27 ml, preferably between 10 and 23 ml, preferably between 10 and 20 ml. Without wishing to be bound by theory, it was found that by carefully regulating the volume, the detergent pouch was less likely to become trapped between the door and the seal, or within the seal itself of an automatic laundry washing machine.

The detergent pouch may have a weight of less than 30 g, or even between 10 g and 28 g, or even between 10 g and 25 g. Without wishing to be bound by theory, it was found that by carefully regulating the weight, the detergent pouch was less likely to become trapped between the door and the seal, or within the seal itself of an automatic laundry washing machine.

The detergent pouch may comprise a gas, and wherein the ratio of the volume of said gas to the volume of the liquid laundry detergent composition is between 1:4 and 1:20, or even between 1:5 and 1:15, or even between 1:5 and 1:9. Without wishing to be bound by theory, it was found that by carefully regulating the volume of gas to volume of liquid the dissolution of the film and dispersion of the liquid laundry detergent composition in the wash liquor could be maximised. There is a tendency of highly concentrated surfactant compositions that may be present in the detergent pouch to gel upon contact with water. This gelling effect causes a competition between the internal laundry detergent composition and the film for the available water in the wash liquor. The competition can result in reduced dissolution of the film of the detergent pouch. By providing an air interface rather than a detergent interface for the film results in less competition for the available water and increases the dissolution rate of the film.

Typically, the detergent pouch comprises multiple compartments. The detergent pouch comprises two, and may comprise three, or four or five compartments.

Typically, a water-soluble film is shaped such that it defines the shape of the compartment, such that the compartment is completely surrounded by the film. The compartment may be formed from a single film, or multiple films. For example the compartment may be formed from two films which are sealed together (e.g. heat sealed, solvent sealed or a combination thereof). Typically, the water-soluble film is sealed such that the composition does not leak out of the compartment during storage. However, upon addition of the water-soluble pouch to water, the water-soluble film dissolves and releases the contents of the internal compartment into the wash liquor.

The detergent pouch can be of any form, shape and material which is suitable for holding the composition, i.e. without allowing the release of the composition, and any additional component, from the detergent pouch prior to contact of the detergent pouch with water. The exact execution will depend, for example, on the type and amount of the compositions in the detergent pouch. The detergent pouch may have a substantially, square, rectangular, oval, elliptoid, superelliptical, or circular shape. The shape may or may not include any excess material present as a flange or skirt at the point where two or more films are sealed together. By substantially, we herein mean that the shape has an overall impression of being for example square. It may have rounded corners and/or non-straight sides, but overall it gives the impression of being square for example. The maximum length or maximum width or maximum height may include the flange. Alternatively the maximum length, the maximum width, or the maximum height may not include the flange material and may include the compartments only.

A multi-compartment detergent pouch form may be desirable for such reasons as: separating chemically incompatible ingredients; or where it is desirable for a portion of the ingredients to be released into the wash earlier or later.

The multiple compartments may be arranged in any suitable orientation. For example the detergent pouch may comprise a bottom compartment, and at least a first top compartment, wherein the top compartment is superposed onto the bottom compartment. The detergent pouch may comprise a bottom compartment and at least a first and a second top compartment, wherein the top compartments are arranged side-by-side and are superposed on the bottom compartment; preferably, wherein the article comprises a bottom compartment and at least a first, a second and a third top compartment, wherein the top compartments are arranged side-by-side and are superposed on the bottom compartment. The detergent pouch may comprise a bottom compartment and at least a first and a second top compartment, wherein the top compartments are arranged side-by-side and are superposed on the bottom compartment. The pouch may comprise a bottom compartment and at least a first, a second and a third top compartment, wherein the top compartments are arranged side-by-side and are superposed on the bottom compartment, and wherein the maximum length is between 2 cm and 5 cm, or even between 2 cm and 4 cm, or even between 2 cm and 3 cm, the maximum width is between 2 cm and 5 cm and the maximum height is between 2 cm and 5 cm.

The ratio of the surface area to volume ratio of the combined top compartments to the surface area to volume ratio of bottom compartment may be between 1:1.25 and 1:2.25, or even between 1:1.5 and 1:2. In this context the surface area is that which is in contact with the external environment only, and not that which is in contact with a neighbouring compartment. Without wishing to be bound by theory, it was found that the specific ratios of surface area to volume ratio of the top compartments to the bottom compartment helped reduce the instances of the detergent pouch becoming trapped.

Alternatively, the compartments may all be positioned in a side-by-side arrangement. In such an arrangement the compartments may be connected to one another and share a dividing wall, or may be substantially separated and simple held together by a connector or bridge. Alternatively, the compartments may be arranged in a 'tyre and rim' orientation, i.e. a first compartment is positioned next to a second compartment, but the first compartment at least partially surrounds the second compartment, but does not completely enclose the second compartment.

It may be preferred that the first compartment and second compartment are in side by side configuration such that the compartments are physically joined through together through a seal. Such a configuration helps minimize any migration of ingredients from one compartment to the other during storage, which in turn can lead to an improvement in the storage stability profile of the pouch.

Preferably, the detergent pouch ruptures between 10 seconds and 5 minutes once the detergent pouch has been added to 950 ml of deionised water at 20-21° C. in a 1 L beaker, wherein the water is stirred at 350 rpm with a 5 cm magnetic stirrer bar. By rupture, we herein mean the film is seen to visibly break or split. Shortly after the film breaks or splits the internal liquid detergent composition may be seen to exit the detergent pouch into the surrounding water.

Water-soluble film: The film of the detergent pouch is soluble or dispersible in water, and preferably has a water-solubility of at least 50%, preferably at least 75% or even at least 95%, as measured by the method set out here after using a glass-filter with a maximum pore size of 20 microns: 50 grams±0.1 gram of film material is added in a pre-weighed beaker and 1000 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the film material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred film materials are polymeric materials. The film material can be obtained, for example, by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Preferred films exhibit good dissolution in cold water, meaning unheated water straight from the tap. Preferably such films exhibit good dissolution at temperatures below 25° C., more preferably below 21° C., more preferably below 15° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310, M9467, films described in U.S. Pat. Nos. 6,166,117 and 6,787,512 and PVA films of corresponding solubility and deformability characteristics. Further preferred films are those describes in US2006/0213801, WO 2010/119022, US2011/0188784 and U.S. Pat. No. 6,787,512.

Preferred water soluble films are those resins comprising one or more PVA polymers, preferably said water soluble film resin comprises a blend of PVA polymers. For example, the PVA resin can include at least two PVA polymers, wherein as used herein the first PVA polymer has a viscosity less than the second PVA polymer. A first PVA polymer can have a viscosity of at least 8 cP (cP mean centipoise), 10 cP, 12 cP, or 13 cP and at most 40 cP, 20 cP, 15 cP, or 13 cP, for example in a range of about 8 cP to about 40 cP, or 10 cP to about 20 cP, or about 10 cP to about 15 cP, or about 12 cP to about 14 cP, or 13 cP. Furthermore, a second PVA polymer can have a viscosity of at least about 10 cP, 20 cP, or 22 cP and at most about 40 cP, 30 cP, 25 cP, or 24 cP, for example in a range of about 10 cP to about 40 cP, or 20 to about 30 cP, or about 20 to about 25 cP, or about 22 to about 24, or about 23 cP. The viscosity of a PVA polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20.deg.C. All viscosities specified herein in cP should be understood to refer to the viscosity of 4% aqueous polyvinyl alcohol solution at 20.deg.C, unless specified otherwise. Similarly, when a resin is described as having (or not having) a particular viscosity, unless specified otherwise, it is intended that the specified viscosity is the average viscosity for the resin, which inherently has a corresponding molecular weight distribution.

The individual PVA polymers can have any suitable degree of hydrolysis, as long as the degree of hydrolysis of the PVA resin is within the ranges described herein. Optionally, the PVA resin can, in addition or in the alternative, include a first PVA polymer that has a Mw in a range of about 50,000 to about 300,000 Daltons, or about 60,000 to about 150,000 Daltons; and a second PVA polymer that has a Mw in a range of about 60,000 to about 300,000 Dalions, or about 80,000 to about 250,000 Daltons.

The PVA resin can still further include one or more additional PVA polymers that have a viscosity in a range of about 10 to about 40 cP and a degree of hydrolysis in a range of about 84% to about 92%.

When the PVA resin includes a first PVA polymer having an average viscosity less than about 11 cP and a polydispersity index in a range of about 1.8 to about 2.3, then in one type of embodiment the PVA resin contains less than about 30 wt. % of the first PVA polymer. Similarly, when the PVA resin includes a first PVA polymer having an average viscosity less than about 11 cP and a polydispersity index in a range of about 1.8 to about 2.3, then in another, non-exclusive type of embodiment the PVA resin contains less than about 30 wt. % of a PVA polymer having a Mw less than about 70,000 Daltons.

Of the total PVA resin content in the film described herein, the PVA resin can comprise about 30 to about 85 wt. % of the first PVA polymer, or about 45 to about 55 wt. % of the first PVA polymer. For example, the PVA resin can contain about 50 wt. % of each PVA polymer, wherein the viscosity of the first PVA polymer is about 13 cP and the viscosity of the second PVA polymer is about 23 cP.

One type of embodiment is characterized by the PVA resin including about 40 to about 85 wt. % of a first PVA polymer that has a viscosity in a range of about 10 to about 15 cP and a degree of hydrolysis in a range of about 84% to about 92%. Another type of embodiment is characterized by the PVA resin including about 45 to about 55 wt. % of the first PVA polymer that has a viscosity in a range of about 10 to about 15 cP and a degree of hydrolysis in a range of about 84% to about 92%. The PVA resin can include about 15 to about 60 wt. % of the second PVA polymer that has a viscosity in a range of about 20 to about 25 cP and a degree of hydrolysis in a range of about 84% to about 92%. One contemplated class of embodiments is characterized by the PVA resin including about 45 to about 55 wt. % of the second PVA polymer. When the PVA resin includes a plurality of PVA polymers the PDI value of the PVA resin is greater than the PDI value of any individual, included PVA polymer. Optionally, the PDI value of the PVA resin is greater than 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.5, or 5.0.

Preferably the PVA resin has a weighted, average degree of hydrolysis ($\overline{H^{\circ}}$) between about 80 and about 92%, or between about 83 and about 90%, or about 85 and 89%. For example, $\overline{H^{\circ}}$ for a PVA resin that comprises two or more PVA polymers is calculated by the formula $\overline{H^{\circ}}=\Sigma(Wi\cdot H_i)$ where $W_i$ is the weight percentage of the respective PVA polymer and a $H_i$ is the respective degrees of hydrolysis. Still further it is desirable to choose a PVA resin that has a weighted log viscosity ($\overline{\mu}$) between about 10 and about 25, or between about 12 and 22, or between about 13.5 and about 20. The $\overline{\mu}$ for a PVA resin that comprises two or more PVA polymers is calculated by the formula $\overline{\mu}=e^{\Sigma W_i \cdot ln\ \mu_i}$ where $\mu_i$ is the Viscosity for the respective PVA polymers.

Yet further, it is desirable to choose a PVA resin that has a Resin Selection Index (RSI) in a range of 0.255 to 0.315, or 0.260 to 0.310, or 0.265 to 0.305, or 0.270 to 0.300, or 0.275 to 0.295, preferably 0.270 to 0.300. The RSI is calculated by the formula; $\Sigma(W_i|\mu_i-\mu_t|)/\Sigma(W_i\mu_i)$, wherein $\mu_t$ is seventeen, $\mu_i$ is the average viscosity each of the respective PVOH polymers, and $W_i$ is the weight percentage of the respective PVOH polymers.

Naturally, different film material and/or films of different thickness may be employed in making the compartments of the present invention. A benefit in selecting different films is that the resulting compartments may exhibit different solubility or release characteristics.

The film material herein can also comprise one or more additive ingredients. For example, it can be beneficial to add plasticisers, for example glycerol, ethylene glycol, diethyleneglycol, propylene glycol, sorbitol and mixtures thereof. Other additives may include water and functional detergent additives, including water, to be delivered to the wash water, for example organic polymeric dispersants, etc.

The film may be lactone free. By this we mean that the film does not comprise any lactone. Alternatively, the film may comprise very low levels of lactone that are present due to impurities but which have not been deliberately added. However, essentially the film will be free of lactone.

The film may comprise an area of print. The area of print may cover the entire film or part thereof. The area of print may comprise a single colour or maybe comprise multiple colours, even three colours. The area of print may comprise pigments, dyes, blueing agents or mixtures thereof. The print may be present as a layer on the surface of the film or may at least partially penetrate into the film. The detergent pouch may comprise at least two films, or even at least three films, wherein the films are sealed together. The area of print may be present on one film, or on more than film, e.g. on two films, or even on three films.

The area of print may be achieved using standard techniques, such as flexographic printing or inkjet printing. Preferably, the area of print is achieved via flexographic printing, in which a film is printed, then moulded into the shape of an open compartment. This compartment is then filled with a detergent composition and a second film placed over the compartment and sealed to the first film. The area of print may be on either side of the film.

The area of print may be purely aesthetic or may provide useful information to the consumer.

The area of print may be opaque, translucent or transparent.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

It may be preferred for the water-soluble pouch to comprise a film of polyvinyl alcohol.

First compartment: The first compartment comprises a benefit delivery composition. Preferably, the first compartment comprises essentially only the benefit delivery composition. This leads to an improved storage stability profile of the benefit delivery composition.

Second compartment: The second compartment comprises a detergent ingredient. Typically, the second compartment comprises a liquid laundry detergent composition. Preferably, the second compartment comprises a detergent ingredient that is a non-aqueous solvent selected from diols and/or alkanolamines. Preferably, the second compartment comprises a detergent ingredient that is selected from amphiphilic polymers and/or polyethyleneimine polymers.

Preferably, when the benefit delivery composition comprises perfume, then the second compartment comprises a detergent ingredient that is a non-aqueous solvent selected from diols and/or alkanolamines, and preferably the weight ratio of perfume to non-aqueous solvent is in the range of from X to Y 1:4 to 1:175, more preferably from 1:4 to 1:35.

Benefit delivery composition: The benefit delivery composition comprises a lamellar phase composition and a viscous hydrophobic ingredient. It may be preferred for the benefit delivery composition to consist essentially only of the lamellar phase composition and viscous hydrophobic ingredient. The viscous hydrophobic ingredient and lamellar phase composition are described in more detail below. The benefit delivery composition comprises viscous hydrophobic ingredient, surfactant and fatty amphiphile: these ingredients are described in more detail below. The benefit delivery composition preferably comprises water. The benefit delivery composition may comprise perfume and other ingredients. These other ingredients are described in more detail below. Preferably, the benefit delivery composition comprises silicone.

Preferably, the benefit delivery composition comprises from 50 wt % to less than 90 wt % lamellar phase composition, more preferably from 60 wt % to 80 wt % lamellar phase composition. Preferably, the benefit delivery composition comprises from greater than 10 wt % to 50 wt % silicone, more preferably from 20 wt % to 40 wt % silicone.

Preferably, the weight ratio of lamellar phase composition to silicone present in the benefit delivery agent is in the range of from 1:1 to 8:1, preferably from 2:1 to 6:1, or from 2:1 to 4:1.

Preferably, the benefit delivery composition comprises from greater than 10 wt % to 48 wt % silicone, more preferably from 20 wt % to 35 wt % silicone.

Preferably, the benefit delivery composition comprises from 2 wt % to 10 wt % perfume, more preferably from 4 wt % to 8 wt % perfume. Without wishing to be bound by theory, high perfume levels can disrupt the formation of the lamellar phase composition and break down the lamellar phase.

Preferably, the benefit delivery composition comprises from 10 wt % to 30 wt % surfactant, more preferably from 10 wt % to 20 wt % surfactant. Preferably, the benefit delivery composition comprises from 5 wt % to 20 wt % fatty amphiphile, more preferably from 5 wt % to 10 wt % fatty amphiphile. The benefit delivery composition may also comprise water, preferably from 0 wt % water to 75 wt % water, more preferably 20 wt % to 75 wt % water, or even from 50 wt % to 75 wt % water.

Upon dissolution with deionized water at a temperature of 25° C. and a dilution of 1 g/l, the benefit delivery composition forms droplets, wherein the droplets have a volume average droplet size in the range of from 20 μm to 1000 μm, more preferably from 20 μm to 500 μm, or from 20 μm to 150 μm. Without wishing to be bound by theory, ensuring this droplet size distribution leads to good surface deposition, especially on fabric surfaces. Preferably, less than 50% by volume of the droplets have a droplet size greater than 150 μm micrometers, more preferably less than 25%, or less than 10% or even less than 5% by volume of the droplets have a droplet size greater than 150 μm. Without wishing to be bound by theory, by controlling the droplet size in this manner, the benefit delivery composition exhibits good surface deposition without the unwanted visual appearance of oily deposits on the surface. The method for measuring the droplet size of the benefit delivery composition is described in more detail below.

When the viscous hydrophobic ingredient comprises polydimethylsiloxane then preferably the benefit delivery composition comprises at least 10 wt % polydimethylsiloxane.

When the viscous hydrophobic ingredient comprises polydimethylsiloxane, then preferably the benefit delivery composition comprises a mixture of polydimethylsiloxane and perfume.

The benefit delivery composition may comprise an ingredient selected from perfume, senso aids, photobleach, brighteners, hueing dye, skin care, sunblock compounds, pigment and any combination thereof. Preferably, the benefit delivery composition comprises perfume.

Preferably, the benefit delivery composition is free of cationic ingredients.

When the benefit delivery composition comprises perfume then preferably the second compartment comprises a detergent ingredient that is a non-aqueous solvent selected from diols and/or alkanolamines, and preferably the weight ratio of perfume to non-aqueous solvent is in the range of from 1:4 to 1:175, preferably from 1:4 to 1:35.

Lamellar phase composition: The lamellar phase composition comprises a mixture of surfactant and fatty amphiphile in lamellar phase.

The lamellar phase composition comprises surfactant and fatty amphiphile, preferably the lamellar phase composition comprises glycerol and/or water. Preferably, the lamellar phase composition consists essentially only of surfactant, fatty amphile, glycerol and water. Preferably, the molar ratio of surfactant to fatty amphiphile present in the lamellar phase composition is in the range of from 1:1 to 2.5:1, more preferably 1:1 to 1.5:1. Without wishing to be bound by theory, by controlling the molar ratio in this manner, the resultant droplet size of the benefit delivery composition upon contact with water can be controlled. Without wishing to be bound by theory, increasing the molar amount of fatty amphiphile relative to the molar amount of surfactant increases the resultant droplet size of the benefit deliver composition upon contact with water.

Preferably, the lamellar phase composition has a packing parameter in the range of from 0.5 to 1.0. The packing parameter and method for determining the packaging parameter is described in more detail below.

Preferably, the lamellar phase composition comprises water and glycerol. Preferably, the weight ratio of water to glycerol present in the lamellar phase composition is in the range of from 1:1 to 10:1, preferably 6:1 to 8:1. Controlling such levels of water and glycerol in this manner improves the compatibility of incorporating the lamellar phase composition in the detergent pouch.

Viscous hydrophobic ingredient: The viscous hydrophobic ingredient comprises silicone and/or petrolatum.

When the viscous hydrophobic ingredient comprises polydimethylsiloxane then preferably the benefit delivery composition comprises at least 10 wt % polydimethylsiloxane.

When the viscous hydrophobic ingredient comprises polydimethylsiloxane then preferably the benefit delivery composition comprises a mixture of polydimethylsiloxane and perfume.

Suitable silicones are selected from the group consisting of cyclic silicones, polydimethylsiloxanes, aminosilicones, cationic silicones, silicone polyethers, silicone resins, silicone urethanes, and mixtures thereof.

A preferred silicone is a polydialkylsilicone, alternatively a polydimethyl silicone (polydimethyl siloxane or "PDMS"), or a derivative thereof. Preferably, the silicone has a viscosity at a temperature of 25° C. and a shear rate of 1000 $s^{-1}$ in the range of from 10 Pa s to 100 Pa s. Without wishing to be bound by theory, increasing the viscosity of the silicone improves the deposition of the perfume onto the treated surface. However, without wishing to be bound by theory, if the viscosity is too high, it is difficult to process and form the benefit delivery composition. A preferred silicone is AK 60000 from Wacker, Munich, Germany Other suitable silicones are selected from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof. Suitable silicones are selected from random or blocky organosilicone polymers having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

- j is an integer from 0 to about 98; in one aspect j is an integer from 0 to about 48; in one aspect, j is 0;
- k is an integer from 0 to about 200, in one aspect k is an integer from 0 to about 50; when k=0, at least one of $R_1$, $R_2$ or $R_3$ is —X—Z;
- m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of —$(CH_2)_s$— wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

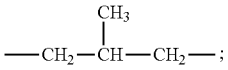

each Z is selected independently from the group consisting of

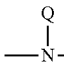

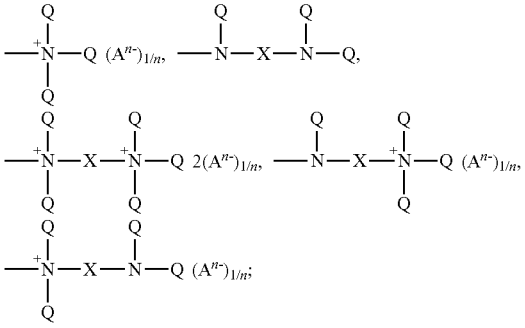

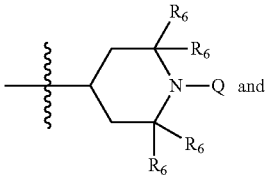

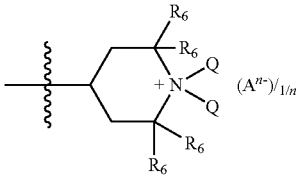

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

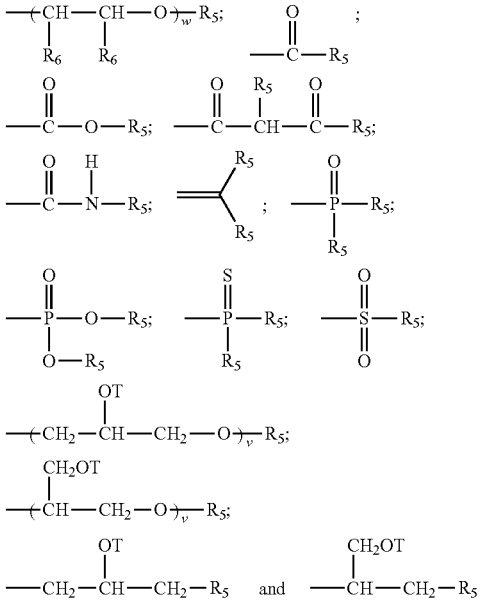

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

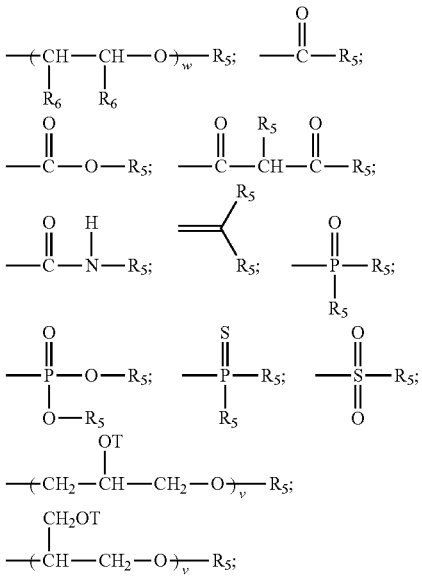

-continued

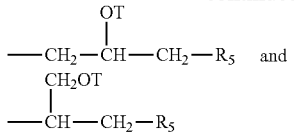

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6—CHR_6—O—)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

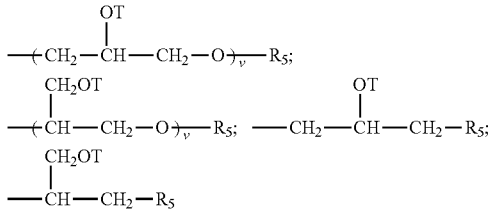

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In another embodiment, the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$═—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

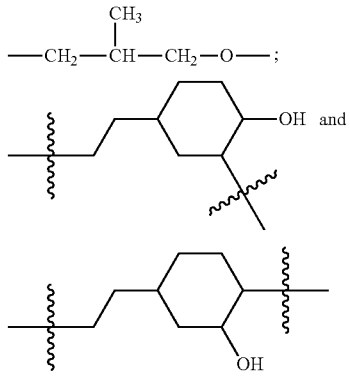

wherein each s independently is an integer from about 2 to about 8, in one aspect s is an integer from about 2 to about 4;

At least one Z in the said organosiloxane is selected from the group consisting of $R_5$;

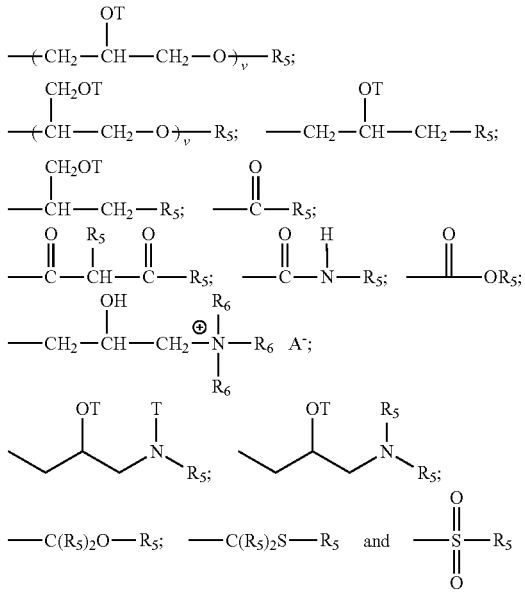

provided that when X is

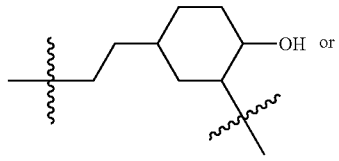

-continued

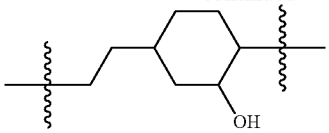

then Z═—$OR_5$ or

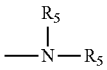

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

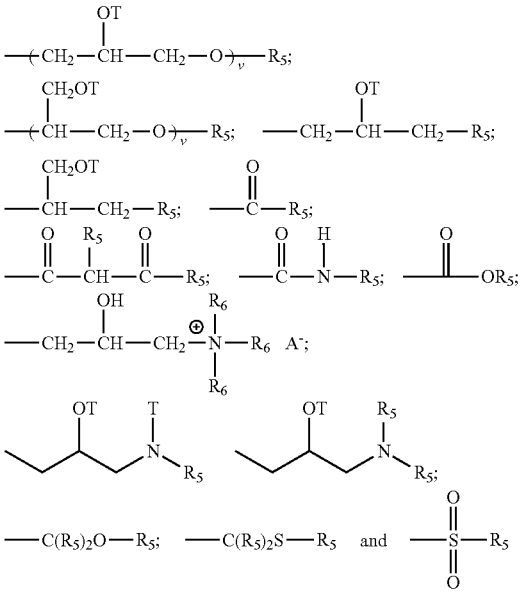

provided that when X is

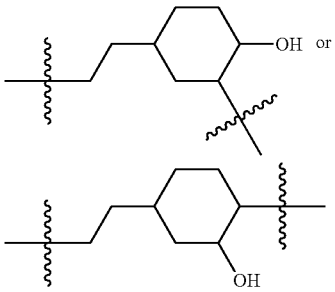

then Z═—$OR_5$ or

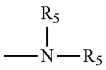

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6—CHR_6—O—)_w$—$CHR_6$—$CHR_6$-L and siloxyl residue wherein each L is independently selected from —O—C(O)—$R_7$ or —O—$R_7$;

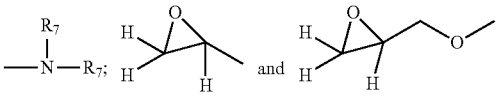

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

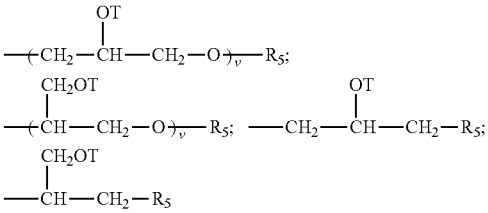

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

A suitable silicone is a blocky cationic organopolysiloxane having the formula:

$$M_wD_xT_yQ_z$$

wherein:

M=[$SiR_1R_2R_3O_{1/2}$], [$SiR_1R_2G_1O_{1/2}$], [$SiR_1G_1G_2O_{1/2}$], [$SiG_1G_2G_3O_{1/2}$], or combinations thereof;

D=[$SiR_1R_2O_{2/2}$], [$SiR_1G_1O_{2/2}$], [$SiG_1G_2O_{2/2}$] or combinations thereof;

T=[$SiR_1O_{3/2}$], [$SiG_1O_{3/2}$] or combinations thereof;

Q=[$SiO_{4/2}$];

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$; and $G_1$, $G_2$, and $G_3$ are each independently selected from the formula:

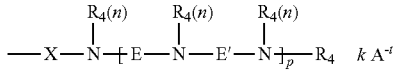

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and 0;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$; wherein t is an integer independently selected from 1, 2, or 3; and $k \leq (p*2/t)+1$; such that the total number of cationic charges balances the total number of anionic charges in the organopolysiloxane molecule; and wherein at least one E does not comprise an ethylene moiety.

Surfactant: Suitable surfactants include anionic surfactants, non-ionic surfactants, zwitterionic surfactants and amphoteric surfactants.

Suitable anionic detersive surfactants include sulphate and sulphonate detersive surfactants.

Suitable sulphonate detersive surfactants include alkyl benzene sulphonate, such as $C_{10}$-13 alkyl benzene sulphonate. Suitable alkyl benzene sulphonate (LAS) is obtainable, or even obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. Another suitable anionic detersive surfactant is alkyl benzene sulphonate that is obtained by DETAL catalyzed process, although other synthesis routes, such as HF, may also be suitable. A preferred surfactant is alkyl benzene sulphonate.

Suitable sulphate detersive surfactants include alkyl sulphate, such as $C_{8-18}$ alkyl sulphate, or predominantly $C_{12}$ alkyl sulphate. The alkyl sulphate may be derived from natural sources, such as coco and/or tallow. Alternative, the alkyl sulphate may be derived from synthetic sources such as $C_{12-15}$ alkyl sulphate.

Another suitable sulphate detersive surfactant is alkyl alkoxylated sulphate, such as alkyl ethoxylated sulphate, or a $C_{8-18}$ alkyl alkoxylated sulphate, or a $C_{8-18}$ alkyl ethoxylated sulphate. The alkyl alkoxylated sulphate may have an average degree of alkoxylation of from 0.5 to 20, or from 0.5 to 10. The alkyl alkoxylated sulphate may be a $C_{8-18}$ alkyl ethoxylated sulphate, typically having an average degree of ethoxylation of from 0.5 to 10, or from 0.5 to 7, or from 0.5 to 5 or from 0.5 to 3. The alkyl sulphate, alkyl alkoxylated sulphate and alkyl benzene sulphonates may be linear or branched, substituted or un-substituted.

Suitable anionic detersive surfactant may be a mid-chain branched anionic detersive surfactant, such as a mid-chain branched alkyl sulphate and/or a mid-chain branched alkyl benzene sulphonate. The mid-chain branches are typically $C_{1-4}$ alkyl groups, such as methyl and/or ethyl groups.

Another suitable anionic detersive surfactant is alkyl ethoxy carboxylate.

The anionic detersive surfactants are typically present in their salt form, typically being complexed with a suitable cation. Suitable counter-ions include alkanolamine cations, $Na^+$ and/or $K^+$.

Suitable non-ionic detersive surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein optionally the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, typically having an average degree of alkoxylation of from 1 to 30; alkylpolysaccharides, such as alkylpolyglycosides; polyhydroxy fatty acid amides; ether capped poly(oxyalkylated) alcohol surfactants; and mixtures thereof. Suitable nonionic detersive surfactants include secondary alcohol-based detersive surfactants. Other suitable non-ionic detersive surfactants include EO/PO block copolymer surfactants, such as the Plurafac® series of surfactants available from BASF, and sugar-derived surfactants such as alkyl N-methyl glucose amide.

Preferred surfactants include alkyl benzene sulphonate, alkyl ethoxylated sulphate, and mixtures thereof. Preferred surfactants include $C_{10}$-$C_{13}$ alkyl benzene sulphonate, $C_{12}$-$C_{15}$ alkyl ethoxylated sulphate having an average degree of ethoxylation in the range of from 1.0 to 5.0 and mixtures thereof. Preferably the surfactant is an anionic surfactant having a cationic counter-ion selected from sodium or calcium. Preferably, the surfactant has a HLB in the range of from 30 to 40.

Fatty Amphiphile: Suitable fatty amphiphiles are selected from fatty acid, fatty alcohol and mixtures thereof. Preferred fatty amphiphiles are selected from $C_8$-$C_{16}$ fatty acid, $C_8$-$C_{16}$ fatty alcohol and mixtures thereof. A highly preferred fatty amphiphile is $C_{12}$ fatty acid. Preferably, the fatty amphiphile has a melting point of at least 40° C., more preferably at least 50° C. or even at least 60° C. Preferably, the fatty amphiphile is a fatty acid having a pKa in the range of from 6 to 8. Preferably, the fatty amphiphile has a HLB in the range of from 10 to 20.

Perfume: Suitable perfumes comprise perfume materials selected from the group: (a) perfume materials having a ClogP of less than 3.0 and a boiling point of 250° C. or greater (herein: "quadrant 2 perfume materials"); (b) perfume materials having a ClogP of 3.0 or greater and a boiling point of less than 250° C. (herein: "quadrant 3 perfume materials"); (c) perfume materials having a ClogP of 3.0 or greater and a boiling point of 250° C. or greater (herein: "quadrant 4 perfume materials"); and (d) mixtures thereof.

Suitable perfumes comprise, based on total perfume weight, at least 60 wt %, preferably at least 80 wt %, or even at least 95 wt % perfume materials selected from quadrant 2 perfume materials, quadrant 3 perfume materials and quadrant 4 perfume materials.

Suitable perfumes comprise, based on total perfume weight, at least 50 wt %, preferably at least 70 wt %, or even at least 90 wt % perfume materials selected from, quadrant 3 perfume materials and quadrant 4 perfume materials.

It may be preferred for the perfume to be in the form of a perfume delivery technology. Such delivery technologies further stabilize and enhance the deposition and release of perfume materials from treated substrate. Such perfume delivery technologies can also be used to further increase the longevity of perfume release from the treated substrate. Suitable perfume delivery technologies are selected from the group consisting of: perfume microcapsule, pro-perfume, polymer assisted delivery, molecule assisted delivery, fiber assisted delivery, amine assisted delivery, cyclodextrin, starch encapsulated accord, zeolite and other inorganic carrier, and mixtures thereof:

A suitable perfume delivery technology is a perfume microcapsule formed by at least partially surrounding, preferably completely surrounding, the perfume with a wall material. Suitable wall materials are selected from melamine, polyacrylamide, silica, polystyrene, polyurea, polyurethanes, polyacrylate based materials, gelatin, styrene malic anhydride, polyamides, and mixtures thereof. Suitable melamine wall materials are selected from melamine crosslinked with formaldehyde, melamine-dimethoxyethanol crosslinked with formaldehyde, and mixtures thereof. Suitable perfume microcapsules may be coated with a deposition aid. Suitable deposition aids are selected from cationic polymer, non-ionic polymer, anionic polymer, and mixtures thereof. Suitable polymers are selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, cationically modified hydroxyethyl cellulose and combinations thereof.

Liquid Laundry Detergent Composition: The detergent pouch may comprise a liquid laundry detergent composition. The liquid composition may be opaque, transparent or translucent. Each compartment may comprise the same or a different composition. The detergent pouch may comprise a liquid composition, however, it may also comprise different compositions in different compartments. The composition may be any suitable composition. The composition may be in the form of a solid, a liquid, a dispersion, a gel, a paste, a fluid or a mixture thereof. The composition may be in different forms in the different compartments. The laundry detergent composition may be used during the main wash process or could be used as pre-treatment or soaking compositions.

Laundry detergent compositions include fabric detergents, fabric softeners, 2-in-1 detergent and softening, pretreatment compositions and the like. Laundry detergent compositions may comprise surfactants, builders, chelating agents, dye transfer inhibiting agents, dispersants, enzymes, and enzyme stabilizers, catalytic materials, bleach activators, polymeric dispersing agents, clay soil removal/anti-redeposition agents, brighteners, suds suppressors, dyes, additional perfume and perfume delivery systems, structure elasticizing agents, fabric softeners, carriers, hydrotropes, processing aids and/or pigments and mixtures thereof. The composition may be a laundry detergent composition comprising an ingredient selected from the group comprising a shading dye, surfactant, polymers, perfumes, encapsulated perfume materials, structurant and mixtures thereof.

The liquid laundry detergent composition may comprise an ingredient selected from, bleach, bleach catalyst, dye, hueing dye, cleaning polymers including alkoxylated polyamines and polyethyleneimines, soil release polymer, surfactant, solvent, dye transfer inhibitors, chelant, enzyme, perfume, encapsulated perfume, polycarboxylates, structurant and mixtures thereof.

Surfactants can be selected from anionic, cationic, zwitterionic, non-ionic, amphoteric or mixtures thereof. Preferably, the fabric care composition comprises anionic, non-ionic or mixtures thereof.

The anionic surfactant may be selected from linear alkyl benzene sulfonate, alkyl ethoxylate sulphate and combinations thereof.

Suitable anionic surfactants useful herein can comprise any of the conventional anionic surfactant types typically used in liquid detergent products. These include the alkyl benzene sulfonic acids and their salts as well as alkoxylated or non-alkoxylated alkyl sulfate materials.

Suitable nonionic surfactants for use herein include the alcohol alkoxylate nonionic surfactants. Alcohol alkoxylates are materials which correspond to the general formula: $R^1(C_mH_{2m}O)_nOH$ wherein R' is a $C_8$-$C_{16}$ alkyl group, m is from 2 to 4, and n ranges from about 2 to 12. In one aspect, $R^1$ is an alkyl group, which may be primary or secondary, that comprises from about 9 to 15 carbon atoms, or from about 10 to 14 carbon atoms. In one aspect, the alkoxylated fatty alcohols will also be ethoxylated materials that contain on average from about 2 to 12 ethylene oxide moieties per molecule, or from about 3 to 10 ethylene oxide moieties per molecule.

The shading dyes employed in the present laundry detergent compositions may comprise polymeric or non-polymeric dyes, pigments, or mixtures thereof. Preferably the shading dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are preferred.

The shading dye may comprise a dye polymer comprising a chromophore covalently bound to one or more of at least three consecutive repeat units. It should be understood that the repeat units themselves do not need to comprise a chromophore. The dye polymer may comprise at least 5, or at least 10, or even at least 20 consecutive repeat units.

The repeat unit can be derived from an organic ester such as phenyl dicarboxylate in combination with an oxyalkyleneoxy and a polyoxyalkyleneoxy. Repeat units can be derived from alkenes, epoxides, aziridine, carbohydrate including the units that comprise modified celluloses such as hydroxyalkylcellulose; hydroxypropyl cellulose; hydroxypropyl methylcellulose; hydroxybutyl cellulose; and, hydroxybutyl methylcellulose or mixtures thereof. The repeat units may be derived from alkenes, or epoxides or mixtures thereof. The repeat units may be $C_2$-$C_4$ alkyleneoxy groups, sometimes called alkoxy groups, preferably derived from $C_2$-$C_4$ alkylene oxide. The repeat units may be $C_2$-$C_4$ alkoxy groups, preferably ethoxy groups.

For the purposes of the present invention, the at least three consecutive repeat units form a polymeric constituent. The polymeric constituent may be covalently bound to the chromophore group, directly or indirectly via a linking group. Examples of suitable polymeric constituents include polyoxyalkylene chains having multiple repeating units. In one aspect, the polymeric constituents include polyoxyalkylene chains having from 2 to about 30 repeating units, from 2 to about 20 repeating units, from 2 to about 10 repeating units or even from about 3 or 4 to about 6 repeating units. Non-limiting examples of polyoxyalkylene chains include ethylene oxide, propylene oxide, glycidol oxide, butylene oxide and mixtures thereof.

The dye may be introduced into the detergent composition in the form of the unpurified mixture that is the direct result of an organic synthesis route. In addition to the dye polymer therefore, there may also be present minor amounts of un-reacted starting materials, products of side reactions and mixtures of the dye polymers comprising different chain lengths of the repeating units, as would be expected to result from any polymerisation step.

The compositions can comprise one or more detergent enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof. A typical combination is a cocktail of conventional applicable enzymes like protease, lipase, cutinase and/or cellulase in conjunction with amylase.

The laundry detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition.

The composition may comprise a brightener. Suitable brighteners are stilbenes, such as brightener 15. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

The compositions herein may also optionally contain one or more copper, iron and/or manganese chelating agents. If utilized, chelating agents will generally comprise from about 0.1% by weight of the compositions herein to about 15%, or even from about 3.0% to about 15% by weight of the compositions herein.

The composition may comprise a calcium carbonate crystal growth inhibitor, such as one selected from the group consisting of: 1-hydroxyethanediphosphonic acid (HEDP) and salts thereof; N,N-dicarboxymethyl-2-aminopentane-1,5-dioic acid and salts thereof; 2-phosphonobutane-1,2,4-tricarboxylic acid and salts thereof; and any combination thereof.

The compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in the compositions herein, the dye transfer inhibiting agents are present at levels from about 0.0001%, from about 0.01%, from about 0.05% by weight of the cleaning compositions to about 10%, about 2%, or even about 1% by weight of the cleaning compositions.

The laundry detergent composition may comprise one or more polymers. Suitable polymers include carboxylate polymers, polyethylene glycol polymers, polyester soil release polymers such as terephthalate polymers, amine polymers, cellulosic polymers, dye transfer inhibition polymers, dye lock polymers such as a condensation oligomer produced by condensation of imidazole and epichlorhydrin, optionally in ratio of 1:4:1, hexamethylenediamine derivative polymers, and any combination thereof.

Other suitable cellulosic polymers may have a degree of substitution (DS) of from 0.01 to 0.99 and a degree of blockiness (DB) such that either DS+DB is of at least 1.00 or $DB+2DS-DS^2$ is at least 1.20. The substituted cellulosic polymer can have a degree of substitution (DS) of at least 0.55. The substituted cellulosic polymer can have a degree of blockiness (DB) of at least 0.35. The substituted cellulosic polymer can have a DS+DB, of from 1.05 to 2.00. A suitable substituted cellulosic polymer is carboxymethylcellulose.

Another suitable cellulosic polymer is cationically modified hydroxyethyl cellulose.

Suitable perfumes include perfume microcapsules, polymer assisted perfume delivery systems including Schiff base perfume/polymer complexes, starch-encapsulated perfume accords, perfume-loaded zeolites, blooming perfume accords, and any combination thereof. A suitable perfume microcapsule is melamine formaldehyde based, typically comprising perfume that is encapsulated by a shell comprising melamine formaldehyde. It may be highly suitable for such perfume microcapsules to comprise cationic and/or cationic precursor material in the shell, such as polyvinyl formamide (PVF) and/or cationically modified hydroxyethyl cellulose (catHEC).

Suitable suds suppressors include silicone and/or fatty acid such as stearic acid.

The liquid laundry detergent composition maybe coloured. The colour of the liquid laundry detergent composition may be the same or different to any printed area on the film of the article. Each compartment of the detergent pouch may have a different colour. Preferably, the liquid laundry detergent composition comprises a non-substantive dye having an average degree of alkoxylation of at least 16.

At least one compartment of the detergent pouch may comprise a solid. If present, the solid may be present at a concentration of at least 5% by weight of the detergent pouch.

Process of Making a Pouch: wherein the process comprises the steps of:

(a) contacting a surfactant and a fatty amphiphile to form a lamellar phase composition;

(b) contacting the lamellar phase composition with viscous hydrophobic ingredient, preferably silicone, to form the benefit delivery composition, (c) enclosing the benefit delivery composition with a water-soluble film to form a multi-compartment pouch, wherein the fatty amphiphile has a melting point of at least 40° C., wherein in step (a) the fatty amphiphile is at a temperature above its melting point when it is contacted with the surfactant, and wherein the fatty amphiphile is subsequently cooled to a temperature below its melting point.

Step (a). Forming a Lamellar Phase Composition: During step (a), a surfactant is contacted to a fatty amphiphile to form a lamellar phase composition. During step (a), the fatty amphiphile is at a temperature above its melting point when it is contacted with the surfactant. Preferably, the surfactant is at a temperature above the melting point of the fatty amphiphile when it is contacted with the fatty amphiphile. If present, preferably the water is at a temperature above the melting point of the fatty amphiphile when it is contacted to the fatty amphiphile. The surfactant and fatty amphiphile may be contacted at a temperature of at least 40° C., or even at least 70° C. Preferred heating means include hot water jacketing and/or hot oil jacketing. Other heating means include direct heat, electrical tracing, steam heating.

Suitable equipment for contacting the surfactant to the fatty amphiphile include mixers such as DPM range of high torque mixers from Charles Ross & Son Company, Hauppauge, N.Y.

Preferably, step (a) is carried out at a pH in the range of from 4.0 to 7.0, more preferably from 5.0 to 6.0. When the fatty amphiphile is a fatty acid, preferably step (a) is carried out at a pH that corresponds to, or is similar to, the pKa of the fatty acid. When the fatty amphiphire is a fatty acid, preferably step (a) is carried out at a pH no greater than 0.5 pH units above the pKa of the fatty acid, and no less than 0.5 pH units below the pKa of the fatty acid.

Step (b). Forming a Benefit Delivery Composition: During step (b), the lamellar phase composition is contacted to viscous hydrophobic material, preferably silicone, to form the benefit delivery composition. Preferably, the step (b) is carried out under conditions of low shear, typically having a maximum tip speed of 2.5 $ms^{-1}$, preferably 2.0 $ms^{-1}$, or even 1.5 $ms^{-1}$. Preferably, step (b) is carried out at a maximum shear rate of 500 $s^{-1}$, or from 400 $s^{-1}$ or even 300 $s^{-1}$. Without wishing to be bound by theory, carefully controlling the shear conditions in this manner result in a benefit delivery composition having a good surface deposition profile: high shear rates can lead to undesirably small droplet sizes of the resultant benefit delivery composition upon contact with water, which in turn lead to a poor deposition profile. Suitable equipment for carrying out step (b) include DPM range of high torque mixers from Charles Ross & Son Company, Hauppauge, N.Y.

Step (c). Forming a Multi-Compartment Pouch: During step (c), the benefit delivery composition is enclosed by a water-soluble film to form a multi-compartment pouch.

The process of forming the pouch may be continuous or intermittent. The process typically comprises the general steps of forming an open pouch, preferably by forming a water-soluble film into a mould to form said open pouch, filling the open pouch with a composition, closing the open pouch filled with a composition, preferably using a second water-soluble film to form the detergent pouch. The second film may also comprise compartments, which may or may not comprise compositions. Alternatively, the second film may be a second closed pouch containing one or more compartments, used to close the open pouch. Preferably, the process is one in which a web of detergent pouch are made, said web is then cut to form individual detergent pouches.

Alternatively, the first film may be formed into an open pouch comprising more than one compartment. In which case, the compartments formed from the first pouch may are in a side-by-side or 'tyre and rim' orientation. The second film may also comprise compartments, which may or may not comprise compositions. Alternatively, the second film may be a second closed pouch used to close the multicompartment open pouch.

The detergent pouch may be made by thermoforming, vacuum-forming or a combination thereof. Detergent pouches may be sealed using any sealing method known in the art. Suitable sealing methods may include heat sealing, solvent sealing, pressure sealing, ultrasonic sealing, pressure sealing, laser sealing or a combination thereof.

The detergent pouches may be dusted with a dusting agent. Dusting agents can include talc, silica, zeolite, carbonate or mixtures thereof.

An exemplary means of making the detergent pouch of the present invention is a continuous process for making an article according to any preceding claims, comprising the steps of:

a. continuously feeding a first water-soluble film onto a horizontal portion of an continuously and rotatably moving endless surface, which comprises a plurality of moulds, or onto a non-horizontal portion thereof and continuously moving the film to said horizontal portion;

b. forming from the film on the horizontal portion of the continuously moving surface, and in the moulds on the surface, a continuously moving, horizontally positioned web of open pouches;

c. filling the continuously moving, horizontally positioned web of open pouches with a product, to obtain a horizontally positioned web of open, filled pouches;

d. preferably continuously, closing the web of open pouches, to obtain closed pouches, preferably by feeding a second water-soluble film onto the horizontally positioned web of open, filed pouches, to obtain closed pouches; and e. optionally sealing the closed pouches to obtain a web of closed pouches.

The second water-soluble film may comprise at least one open or closed compartment.

In one embodiment, a first web of open pouches is combined with a second web of closed pouches preferably wherein the first and second webs are brought together and sealed together via a suitable means, and preferably wherein the second web is a rotating drum set-up. In such a set-up, pouches are filled at the top of the drum and preferably sealed afterwards with a layer of film, the closed pouches come down to meet the first web of pouches, preferably open pouches, formed preferably on a horizontal forming surface. It has been found especially suitable to place the rotating drum unit above the horizontal forming surface unit.

Preferably, the resultant web of closed pouches are cut to produce individual detergent pouches.

The film may comprise an area of print. The area of print may cover the entire film or part thereof. The area of print may comprise a single colour or maybe comprise multiple colours, even three colours. The area of print may comprise white, black and red colours. The area of print may comprise pigments, dyes, blueing agents or mixtures thereof. The print may be present as a layer on the surface of the film or may at least partially penetrate into the film. The area of print may be present on the outside of the detergent pouch, or maybe on the inner surface of the film, i.e. in contact with the liquid laundry detergent composition. Alternatively, the area of print may be present ion both the outside and the inside of the detergent pouch.

The detergent pouch may comprise at least two films, or even at least three films, wherein the films are sealed together. The area of print may be present on one film, or on more than film, e.g. on two films, or even on three films.

The area of print may be achieved using standard techniques, such as flexographic printing or inkjet printing. Preferably, the area of print is achieved via flexographic printing, in which a film is printed, then moulded into a detergent pouch via steps a-e above. Printing may be on the inside or the outside of the detergent pouch.

Those skilled in the art would recognize the appropriate size of mould needed in order to make a detergent pouch according to the present invention.

Optional process step. Forming a premix composition: It may be preferred for the viscous hydrophobic ingredient, especially silicone, to be contacted to a perfume to form a premix composition prior to contacting the viscous hydrophobic material to the lamellar phase composition. Suitable vessels for this premixing process step include mixers such as the SPP series of mixers from IKA Werke GmbH & Co. KG, Staufen, Germany.

If this optional process step is included in the process, then it may be preferred that prior to this optional process step, the lamellar phase composition is cooled to a temperature below its melting point. Suitable cooling means include water jacketing and a stirred vessel.

Packing Parameter: The surfactant Packing Parameter (N), is calculated from various molecular descriptors of the surfactant molecule's chemical structure, as described in more detail below. The surfactant Packing Parameter (N) is defined as:

$$N=v/la_0$$

wherein, v is the volume of the hydrocarbon core in cubic nanometers, l is the length of the hydrocarbon chains, and $a_0$ is the area of the surfactant head-group at the interface of the hydrophobic core.

The volume of the hydrocarbon core of a saturated chain (v), in cubic nanometers, is determined according to the following equation:

$$v=0.027(n_c+n_{Me})$$

wherein, $n_c$ is the total number of carbon atoms per chain, and $n_{Me}$ is the number of methyl groups which are twice the size of a $CH_2$ group.

The maximum length of a fully extended hydrocarbon chain (1) (in nanometers) is calculated according to the following equation:

$$1=0.15+0.127n_c$$

wherein, $n_c$ is the total number of carbon atoms per chain.

The 0.15 nm in this equation comes from van der Waals radius of the terminal methyl group (0.21 nm) minus half the bond length of the first atom not contained in the hydrocarbon core (0.06 nm). The 0.127 nm is the carbon-carbon bond length (0.154 nm) projected onto the direction of the chain in the all-trans configuration.

The area of the surfactant head-group at the interface of the hydrophobic core ($a_0$), is determined according to the calculations described in the following published article: "Theory of Self-Assembly of Hydrocarbon Amphiphiles into Micelles and Bilayers" 1976, J. Chem. Soc., Faraday Trans. 2, 72, 1525-1568, Jacob N. Israelachvili, D. John Mitchell and Barry W. Ninham.

ClogP: The logP values of many perfume materials have been reported; for example, the Pomona92 database, available from Daylight Chemical Information Systems, Inc. (Daylight CIS, Irvine, Calif.), contains many, along with citations to the original literature. However, the logP values are most conveniently calculated by the "CLOGP" program, also available from Daylight CIS. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A Ramsden, Eds., p. 295, Pergamon Press, 1990). The fragment approach is based on the chemical structure of each perfume ingredient, and takes into account the numbers and types of atoms, the atom connectivity, and chemical bonding.

Boiling Point: The boiling point of perfume material is measured according to standard test method ASTM D2887-04a, "Standard Test Method for Boiling Range Distribution of Petroleum Fractions by Gas Chromatography," (ASTM International, West Conshohocken, Pa., USA".

Melting Point: The Melting Point value is determined using the widely used standard Differential Scanning calorimetry methodology described in the following published article: "Comprehensive Evaluation of the Melting Points of Fatty Acids and Esters Determined by Differential Scanning calorimetry". J. Am. Oil Chem. Soc. (2009). 86:843-856A.

pKa: The pKa value is the negative log (base 10) of the acid dissociation constant. The acid dissociation constant, $K_a$, is the equilibrium constant for the acid-base dissociation reaction. The equilibrium of acid dissociation can be written symbolically as:

$$HA \rightleftharpoons A^- + H^+$$

where HA is a generic acid that dissociates by splitting into $A^-$, known as the conjugate base of the acid, and the hydrogen ion or proton, $H^+$. The dissociation constant is usually written as a quotient of the equilibrium concentrations (in mol/L), denoted by [HA], $[A^-]$ and $[H^+]$:

$$K_a = \frac{[A^-][H^+]}{[HA]}$$

The logarithmic constant, $pK_a$, which is equal to $-\log_{10} K_a$, is sometimes also referred to as an acid dissociation constant:

$$pK_a = -\log_{10} K_a$$

HLB: The Hydrophilic-Lipophilic Balance (HLB) values are calculated according to the widely used standard methodology contained in the following published article: "The HLB System", 1987, ICI Americas Inc., Wilmington, Del., USA.

Method for Measuring Droplet Size: A Malvern Mastersizer 2000 (Malvern Instruments GmbH, Rigipsstr. 19 Herrenberg 71083 Germany), is used to measure the droplet size of the lamellar gel sample dispersed in filtered deionized (DI) water. The Mastersizer 2000 uses the technique of laser diffraction to measure the size of particles. It does this by measuring the intensity of light scattered as a laser beam passes through a dispersed particulate sample. The sample dispersion is prepared by dissolving 1 g of the lamellar gel sample in 0.8 L filtered deionized water at 40° C., with a mixing speed of 1500 rpm. If this concentration is not sufficient to achieve 20% obscuration in the Mastersizer instrument using the following settings, then additional sample material is added in order to achieve 20% obscuration. The change in droplet size is monitored over a period of 30 minutes. This data is then analyzed to calculate the size of the particles that created the scattering pattern, using the following two refractive indices: 1.333 (dispersant=water), and 1.469 (hydrophobic active materials), and the adsorption parameter of the system is set to 1. The average droplet size is expressed as the mean volume average diameter.

Method for Measuring Viscosity: The viscosity is measured by the following method, which generally represents the zero-shear viscosity (or zero-rate viscosity). Viscosity measurements are made with an AR2000 Controlled-Stress Rheometer (TA Instruments, New Castle, Del., U.S.A.), and accompanying software version 5.7.0. The instrument is outfitted with a 40 mm stainless steel parallel plate (TA Instruments catalog no. 511400.901) and Peltier plate (TA Instruments catalog no. 533230.901). The calibration is done in accordance with manufacturer recommendations. A refrigerated, circulating water bath set to 25° C. is attached to the Peltier plate.

Measurements are made on the instrument with the following procedures: Conditioning Step (pre-condition the sample) under "Settings" label, initial temperature: 25° C., pre-shear at 5.0 $s^{-1}$ for 1 minute, equilibrate for 2 minutes; Flow-Step (measure viscosity) under "Test" Label, Test Type: "Steady State Flow", Ramp: "shear rate 1/s" from 0.001 $s^{-1}$ and 1000 $s^{-1}$, Mode: "Log", Points per Decade: 15, Temperate: 25° C., Percentage Tolerance: 5, Consecutive with Tolerance: 3, Maximum Point Time: 45 sec, Gap set to 1000 micrometers, Stress-Sweep Step is not checked; Post-Experiment Step under "Settings" label; Set temperature: 25° C.

More than 1.25 ml of the test sample of the component to be measured is dispensed through a pipette on to the center of the Peltier plate. The 40 mm plate is slowly lowered to 1100 micrometers, and the excess sample is trimmed away from the edge of the plate with a rubber policeman trimming tool or equivalent. Lower the plate to 1000 micrometers (gap setting) prior to collecting the data.

Discard any data points collected with an applied rotor torque of less than 1 micro-N m (e.g. discard data less than ten-fold the minimum torque specification). Create a plot of viscosity versus shear rate on a log-log scale. These plotted data points are analyzed in one of three ways to determine the viscosity value:

first, if the plot indicates that the sample is Newtonian, in that all viscosity values fall on a plateau within +/−20% of the viscosity value measured closest to 1 micro-N m, then the viscosity is determined by fitting the 'Newtonian' fit model in the software to all the remaining data;

second, if the plot reveals a plateau in which the viscosity does not change by +/−20% at low shear rates and a sharp, nearly-linear decrease in viscosity in excess of the +/−20% at higher shear rates, then the viscosity is determined by applying the "Best Fit Using Viscosity vs. Rate" option from the "Analysis Toolbar";

third, if the plot indicates that the sample is only shear-thinning, in that there is only a sharp, nearly-linear decrease in viscosity, then the material is characterized by a viscosity which is taken as the largest viscosity in the plotted data, generally a viscosity measured close to 1 micro-N·m of applied torque.

Report the average value of the replicates as the viscosity of the component, in units of Pa·s.

EXAMPLES

Example 1

Benefit delivery composition: The following benefit delivery composition was prepared as described below:

| Ingredients | Lamellar Gel composition |
|---|---|
| Neutralised LAS paste (45% active) | 36.690 wt % |
| Dodecanoic acid | 9.490 wt % |
| Water | 18.642 wt % |
| $Na_2CO3$ | 0.098 wt % |
| NaHCO3 | 0.080 wt % |
| PDMS | 30.000 wt % |
| Perfume | 5.000 wt % |
| Total | 100.000 wt % |

LAS paste neutralization: 72.38 g of LAS paste (45% active) is heated to 60° C. and continuously stirred at 1000 rpm in a heat resistant beaker and HCl (10 M) is added drop wise until a pH of 7.0 is obtained. The LAS paste is then stored in an oven at 50° C. tightly sealed to avoid water evaporation.

Lamellar gel: 18.98 g dodecanoic acid is placed in a plastic container in an oven at 50° C. (above its melting point of 43.2° C.). A stirrer blade is warmed in the oven at 50° C. for at least one hour and then the blade is placed and locked in an overhead stirrer. 72.38 g LAS paste (prepared as described above) is shaken vigourously and dosed into the overhead stirrer. 18.98 g molten dodecanoic acid (prepared as described above) is added to the overhead stirrer and the mixture is stirred at 50° C., 350 rpm for 5 minutes to form a gel. 0.196 g sodium carbonate and 0.160 g sodium bicarbonate are added to 37.284 g deionized water and mixed to form a buffer. 37.64 g buffer is heated to 50° C. and added to the gel (prepared as described above) and stirred for 5 minutes at 350 rpm. The gel is then cooled to room temperature.

Silicone/perfume premix: 60 g silicone (PDMS) and 10 g perfume are mixed in a high speed mixer (Siemens Speed Mixer DAC150FVZK) at 2700 rpm for 3 minutes to form a premix Benefit delivery composition: The premix (prepared as described above) is then added to the gel (prepared as described above) and the gel is stirred at room temperature for 15 minutes at 350 RPM.

Example 2

Liquid laundry detergent composition: The following liquid laundry detergent composition is prepared.

| | |
|---|---|
| 1,2 Propane-diol | 20.954 wt % |
| Glycerine | 10.476 wt % |
| Ethoxylated Non-ionic surfactants | 10.476 wt % |
| Benzene alkyl sulphonate neutralized with monoethanolamine | 41.418 wt % |
| Poliethoxylathedamine polymer | 2.500 wt % |
| DiPropyleneGlycol | 10.476 wt % |
| Polyvinalacetate-Polyethyleneglycol Copolymer | 2.620 wt % |
| Silicone Suds suppressor | 1.080 wt % |

Example 3

Detergent pouch comprising the benefit delivery composition: A multi-compartment detergent pouch was prepared by the following method:

Liquid laundry detergent composition compartment: 19 g of the liquid laundry detergent composition of example 2 is incorporated into a vacuum formed compartment made from a polyvinylalcohol film (monosol M-9467, 76 microns) (PVA film). The PVA film is placed over a square shaped mould and drawn down into the mould by vacuum to form an open compartment. 19 g liquid laundry detergent composition is then placed into the open compartment, and the open compartment is sealed by a second piece of the PVA film, which is sealed by a solvent sealing process using an aqueous PVA solution and a heated sealing plate.

Benefit delivery composition compartment: 4 g of the benefit delivery composition of example 1 is incorporated into a vacuum formed compartment by the method described above for the liquid laundry detergent composition.

Multi-compartment detergent pouch: The liquid laundry detergent composition compartment described above and the benefit delivery composition compartment described above are sealed adjacently together along one of their straight edge seals by sealing the seals together using a solvent sealing process to form a multi-compartment detergent pouch.

Example 4

Liquid laundry detergent composition comprising the benefit delivery composition (non-pouch comparative example): 4 g of the benefit delivery composition of example 1 is contacted to 19 g of the liquid laundry detergent composition of example 2 in a mixing vessel to form the comparative liquid laundry detergent composition.

Example 5

Reference liquid laundry detergent composition (non-benefit delivery agent composition comparative example):

19 g liquid laundry detergent composition of example 2 is contacted to 0.18 g perfume (chemically identical to the perfume incorporated into the benefit delivery composition of example 1) to form the reference liquid laundry detergent composition.

Example 6

Freshness and softness performance profile test: Test protocol: The detergent pouch of example 3, the comparative liquid detergent composition of example 4 and the reference liquid detergent composition of example 5 were tested for freshness and softness performance on fabric using the following test protocol.

Freshness and softening performance method: The detergent pouch of example 2, the comparative liquid detergent composition of example 4 and the reference liquid detergent composition of example 5 are added separately into a mini washing system. The mini washing system is a 8 L water volume mini replica of a top loading automatic washing machine. The hardness of the water used was 8 gpg (54.88 mg calcium/L).

The following fabrics are added into mini-washer pots: 3×Christy Softness Swatches 20 cm×20 cm; 2×⅛th Tonrose Towel 6.25 cm×12.5 cm; these fabrics are supplied by Asda Stores Ltd., Leeds, UK or Optima Cotton Wear 8050 East Crystal Drive, Anaheim, Calif. 92807. The loaded mini-washer pots are agitated for 30 seconds and the sample is then added to the miniwasher pot. The mini-washer then performs a 12 min wash cycle, 2 min spin cycle, 2 min rinse cycle and a further 2 min spin cycle. The treated fabric are dried at 21° C., 55% relative humidity for 15 hours. The fabrics are then graded to assess the fabric's freshness and softness performance profile.

Freshness performance: Panel grading is used to assess the freshness performance profile. The panelists are trained and calibrated and panel the fabrics versus the reference fabric (fabrics treated with the reference liquid detergent composition of example 5) using the following primavera scale where +2.5 indicates a meaningful but not consumer noticeable positive difference versus reference, +5.0 indicates a meaningful and consumer noticeable positive difference versus reference, and +7.5 indicates a meaningful and highly consumer noticeable positive difference versus reference. A difference of 2.5 is considered to be a technical difference on the primavera scale. Four replica fabrics are prepared for each sample, and each fabric is paneled by two different panelists.

Softness paneling: Panel grading is used to assess the softness performance profile. The panelists are trained and calibrated and panel the fabrics versus the reference fabric (fabrics treated with the reference liquid detergent composition of example 5) using the following panel score units (PSU) where −4 is described as significantly very poor versus reference, −3 is poor versus reference, −2 is slightly poor versus reference, −1 is unsure about negative difference versus reference, 0 is no difference versus reference, +1 is unsure about positive difference versus reference, +2 is slightly better versus reference, +3 is suprerior verus reference and +4 is significantly superior versus reference. Four replica fabrics are prepared for each sample, and each fabric is paneled once by three different panelists and the average panel score is calculated.

Results:

| | Freshness performance (primavera delta) | Softness performance (PSU) |
|---|---|---|
| Comparative liquid laundry detergent composition of example 4 | +5.0 | +2.0 |

-continued

| | Freshness performance (primavera delta) | Softness performance (PSU) |
|---|---|---|
| Multi-compartment pouch of example 3 | +20 | +4 |

The multi-compartment pouch of example 3 (in accordance with the present invention) has superior freshness and softness performance profile compared to the comparative liquid laundry detergent composition of example 4.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A multi-compartment laundry detergent water-soluble pouch, wherein the pouch comprises a first compartment and a second compartment, wherein the first compartment comprises a benefit delivery composition comprising;

i) a lamellar phase composition comprising a mixture of surfactant and fatty amphiphile in lamellar phase, and ii) a viscous hydrophobic ingredient comprising silicone and/or petrolatum; and wherein the second compartment comprises a detergent ingredient.

2. A pouch according to claim 1, wherein the surfactant is alkyl benzene sulphonate.

3. A pouch according to claim 1, wherein the viscous hydrophobic ingredient comprises polydimethylsiloxane, and wherein the benefit delivery composition comprises at least about 10%, by weight of the benefit delivery composition, of polydimethylsiloxane.

4. A pouch according to claim 1, wherein the viscous hydrophobic ingredient comprises polydimethylsiloxane, and wherein the benefit delivery composition further comprises perfume.

5. A pouch according to claim 1, wherein the benefit delivery composition further comprises an ingredient selected from the group consisting of perfume, senso aids, photobleach, brighteners, hueing dye, skin care, sunblock compounds, pigment, and mixtures thereof.

6. A pouch according to claim 1, wherein the benefit delivery composition is free of cationic ingredients.

7. A pouch according to claim 1, wherein the second compartment comprises a detergent ingredient that is a non-aqueous solvent selected from the group consisting of diols, alkanolamines, and mixtures thereof.

8. A pouch according to claim 1, wherein the second compartment comprises a detergent ingredient selected from the group consisting of amphiphilic polymers, polyethyleneimine polymers, and mixtures thereof.

9. A pouch according to claim 1, wherein the benefit delivery composition further comprises perfume, and wherein the second compartment comprises a detergent ingredient that is a non-aqueous solvent selected from the group consisting of diols, alkanolamines, and mixtures thereof, and wherein a weight ratio of perfume to non-aqueous solvent is in the range of from about 1:4 to about 1:35.

10. A pouch according to claim 1, wherein the lamellar phase composition further comprises water and glycerol, wherein a weight ratio of water to glycerol present in the lamellar phase composition is in the range of from about 1:1 to about 10:1.

11. A pouch according to claim 1, wherein the first compartment and second compartment are in side by side configuration such that the compartments are physically joined together through a seal.

12. A pouch according to claim 1, wherein the water-soluble pouch comprises a film of polyvinyl alcohol.

13. A process of making a pouch according to claim 1, wherein the process comprises the steps of:

(a) contacting a surfactant and a fatty amphiphile to form a lamellar phase composition;

(b) contacting the lamellar phase composition with silicone to form the benefit delivery composition, (c) enclosing the benefit delivery composition with a water-soluble film to form a multi-compartment pouch, wherein the fatty amphiphile has a melting point of at least about 40° C., wherein in step (a) the fatty amphiphile is at a temperature above its melting point when it is contacted with the surfactant, and wherein the fatty amphiphile is subsequently cooled to a temperature below its melting point.

14. A process according to claim 13, wherein the viscous hydrophobic ingredient further comprises perfume and the silicone is premixed with said perfume prior to contact with the lamellar phase composition.

* * * * *